US011109473B2

(12) United States Patent
Steadman Booker et al.

(10) Patent No.: US 11,109,473 B2
(45) Date of Patent: Aug. 31, 2021

(54) X-RAY SOURCE AND X-RAY IMAGING APPARATUS

(71) Applicant: KONINKLIJKE PHILIPS N.V., Eindhoven (NL)

(72) Inventors: Roger Steadman Booker, Aachen (DE); Gereon Vogtmeier, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/969,725

(22) PCT Filed: Feb. 19, 2019

(86) PCT No.: PCT/EP2019/054011
§ 371 (c)(1),
(2) Date: Aug. 13, 2020

(87) PCT Pub. No.: WO2019/158765
PCT Pub. Date: Aug. 22, 2019

(65) Prior Publication Data

US 2021/0007210 A1 Jan. 7, 2021

(30) Foreign Application Priority Data

Feb. 19, 2018 (EP) ..... 18157305

(51) Int. Cl.
*H05G 1/52* (2006.01)
*H01J 35/14* (2006.01)
(Continued)

(52) U.S. Cl.
CPC ..... *H05G 1/52* (2013.01); *H01J 35/066* (2019.05); *H01J 35/147* (2019.05); *H01J 35/153* (2019.05); *H05G 1/56* (2013.01)

(58) Field of Classification Search
CPC . H05G 1/52; H05G 1/56; H01J 35/147; H01J 35/153; H01J 35/066
See application file for complete search history.

(56) References Cited

U.S. PATENT DOCUMENTS 5,224,137 A * 6/1993 Plomgren ..... A61B 6/032 378/10
2004/0190682 A1* 9/2004 Deuringer ..... H01J 35/14 378/137

(Continued)

OTHER PUBLICATIONS

PCT International Search Report, International application No. PCT/EP2019/054011, dated Aug. 27, 2019.

*Primary Examiner* — Chih-Cheng Kao
(74) *Attorney, Agent, or Firm* — Larry Liberchuk

(57) ABSTRACT

An X-ray source (10) for emitting an X-ray beam (101) is proposed. The X-ray source (10) comprises an anode (12) and an emitter arrangement (14) comprising a cathode (16) for emitting an electron beam (15) towards the anode (12) and an electron optics (18) for focusing the electron beam (15) at a focal spot (20) on the anode (12). The X-ray source (10) further comprises a controller (22) configured to determine a switching action of the emitter arrangement (14) and to actuate the emitter arrangement (14) to perform the switching action, the switching action being associated with a change of at least one of a position of the focal spot (20) on the anode (12), a size of the focal spot (20), and a shape of the focal spot (20). The controller (22) is further configured to predict before the switching action is performed, based on the determined switching action, the size and the shape of the focal spot (20) expected after the switching action. Further, the controller (22) is configured to actuate the electron optics (18) to compensate for a change of the size and the shape of the focal spot (20) induced by the switching action.

13 Claims, 2 Drawing Sheets

(51) Int. Cl.
*H01J 35/06* (2006.01)
*H05G 1/56* (2006.01)

(56) References Cited

U.S. PATENT DOCUMENTS

| | | | | |
|---|---|---|---|---|
| 2006/0115050 | A1 | 6/2006 | Resnick | |
| 2007/0274457 | A1* | 11/2007 | Dunham ..... | H01J 35/14 378/207 |
| 2010/0020938 | A1 | 1/2010 | Koch | |
| 2010/0119039 | A1 | 5/2010 | Miller | |
| 2014/0064456 | A1 | 3/2014 | Zou | |
| 2015/0098548 | A1 | 4/2015 | Bathe | |

* cited by examiner

X-RAY SOURCE AND X-RAY IMAGING APPARATUS

FIELD OF THE INVENTION

The invention relates to the field of X-ray imaging. Particularly, the invention relates to an X-ray source, to an X-ray imaging apparatus, to a method for operating an X-ray source, to a program element, and to a computer-readable medium.

BACKGROUND OF THE INVENTION

In certain X-ray imaging applications, an X-ray beam and/or at least one characteristic of an X-ray beam emitted by an X-ray source of an X-ray imaging apparatus is modified during an imaging task. The X-ray beam may be varied e.g. in shape, size, impinging direction, intensity, frequency of a pulsed X-ray beam, energy, and/or energy distribution. Usually, the X-ray beam is generated by emitting an electron beam from a cathode and focusing, e.g. by means of an electron optics, the electron beam at a focal spot on an anode, where X-ray photons are then generated and emitted to form the X-ray beam.

To manipulate the X-ray beam, e.g. an electrical energy, electrical power, a current, and/or a voltage supplied to the cathode can be varied. Also, a filter may be moved in and/or out of the X-ray beam during operation of the X-ray source. Further, grid switching, spectral filtration and/or dynamic focal spot positioning techniques may be applied to manipulate the X-ray beam.

To ensure a high quality of an X-ray image acquired in such imaging applications and/or to ensure that characteristics of the X-ray beam for a certain imaging task are met, the focal spot of the electron beam at the anode should be precisely controlled. This may be a challenging task, particularly if large variations of the X-ray beam are to be performed.

SUMMARY OF THE INVENTION

It may therefore be desirable to provide for an improved X-ray source and/or an improved X-ray imaging apparatus allowing to acquire a high-quality X-ray image.

This is achieved by the subject-matter of the independent claims, wherein further embodiments are incorporated in the dependent claims and the following description.

Features and/or functions, which are in the following described with reference to one aspect of the invention, equally apply to any other aspect of the invention described in the following. Particularly, features and/or functions described in the following with reference to the X-ray source, equally apply the X-ray imaging apparatus, the method for operating an X-ray source, the program element, and the computer-readable medium, and vice versa.

According to a first aspect of the invention, an X-ray source for emitting an X-ray beam is provided. The X-ray source comprises an anode, an emitter arrangement and a controller. The emitter arrangement comprises a cathode for emitting an electron beam towards the anode and an electron optics for focusing the electron beam at a focal spot on the anode. The electron optics may be configured to focus the electron beam, e.g. based on generating an electric and/or magnetic field deflecting the electron beam. Accordingly, the electron optics may generally refer to a focuser and/or deflector for the electron beam.

The controller is configured to determine a switching action of the emitter arrangement, e.g. for a given imaging task, and to actuate the emitter arrangement to perform the switching action. Therein, the switching action is associated with a change of at least one of a position of the focal spot on the anode, a size of the focal spot, and a shape of the focal spot. Further, the controller is configured to predict before the switching action is performed and/or before performing the switching action, based on the determined switching action, the size and the shape of the focal spot expected after the switching action, after performing the switching action and/or after the switching action is performed. Also, the controller may be configured to predict a position of the focal spot on the anode expected after the switching action.

Further, the controller may, for example, be configured to actuate the electron optics to compensate for a change of the size and the shape of the focal spot induced by the switching action, e.g. expectedly induced based on the predicted size and shape of the focal spot. Therein, the controller may be configured to actuate the electron optics to compensate for the change in size and shape of the focal spot before, during and/or after the switching action is performed, preferably before and/or during the switching action is performed. For this purpose, the controller may be configured to feed-forward a control signal e.g. to the electron optics for actuating the electron optics to compensate for the change in size and shape of the focal spot.

The controller may be configured to predict, estimate and/or determine before, i.e. temporally before, the switching action is initiated, performed, completed and/or terminated the size and the shape of the focal spot expected after the switching action is performed, completed and/or terminated. Accordingly, the term "before the switching action is performed" may refer to directly before the switching action is initiated, while the switching action is performed and/or before the switching action is terminated and/or completed. Likewise, the term "after the switching action" and/or "after the switching is performed" may refer to after the switching action is completed and/or after the switching action is terminated.

The size of the focal spot may refer to a dimension of the focal spot in at least one spatial direction, preferably in two spatial directions. Generally, the focal spot may refer to an area of an outer surface of the anode, in which the electron beam impinges onto the anode. Accordingly, the size of the focal spot may refer to a size of said area on the anode. Further, the shape of the focal spot may refer to a geometrical shape and/or geometry of the focal spot and/or of said area.

Generally, predicting the size and the shape of the focal spot expected after the switching action, allows for a proactive and/or precise control of the focal spot, e.g. based on actuating the electron optics in correspondence with the predicted size and shape of the focal spot. Accordingly, the controller may be configured to control and/or proactively control the size and the shape of the focal spot based on the predicted size and the shape of the focal spot expected after the switching action, e.g. based on actuating the electron optics according to the predicted shape and size of the focal spot. In other words, the controller may be configured to determine and/or compensate for any changes in the focal spot induced by the switching action before these changes actually occur. This may allow to precisely control the X-ray beam emitted from the anode during an X-ray imaging task. For instance, a shape, a size, an impinging direction, an intensity, a frequency of a pulsed X-ray beam, an energy, and/or an energy distribution of the X-ray beam may be precisely controlled based on controlling the size and the shape of the focal spot. Further, by precisely controlling the X-ray beam, an image quality of an acquired X-ray image may be improved, particularly by reducing a noise and/or increasing a resolution of the image. Also, a dose delivered e.g. to a patient may advantageously be reduced.

By way of example, the controller may be configured to provide a predictive control signal indicative and/or representative of the predicted size and shape of the focal spot to the electron optics before the switching action is performed, while the switching action is performed and/or when the switching action is completed. By means of the predictive control signal, the electron beam may be adjusted, modified and/or tuned, such that the focal spot adopts the predicted size and shape after the switching action is performed and/or completed. Further, the controller may be configured to predict the size and the shape of the focal spot in response to determining the switching action and/or in response to determining that the switching action is to be performed. Further, the controller may be configured to actuate the electron optics, e.g. by providing the predictive control signal, in response to predicting the size and the shape of the focal spot expected after the switching action. Moreover, the controller may be configured to initiate the switching action, e.g. based on actuating the emitter arrangement, in response to predicting the size and the shape of the focal spot expected after the switching action and/or in response to actuating the electron optics based on providing the predictive control signal. Particularly, the controller may be configured to actuate the electron optics based on the predicted size and shape of the focal spot before, during or after the switching action is performed.

Generally, the switching action may refer to any adjustment and/or actuation of the X-ray source affecting and/or modifying at least one of the size, the shape and the position of the focal spot on the anode. According to an embodiment, the switching action comprises at least one of changing a voltage supplied to the cathode, changing a current supplied to the cathode, changing an electrical power supplied to the cathode, changing an electric field between the anode and the cathode, changing a position of the focal spot on the anode by deflecting the electron beam with the electron optics, and/or switching the X-ray beam on. Further, moving a filter for spectral filtering in and/or out of the X-ray beam in combination with another adjustment and/or actuation of the X-ray source, such as e.g. a change in a voltage and/or current supplied to the cathode, may also be referred to as switching action. Those kinds of switching actions may particularly be performed when applying kV-peak switching (also referred to as kVp switching), grid switching, spectral filtration and/or dynamic focal spot positioning techniques.

Further, the term "determining the switching action" may mean that the controller is configured to determine one or more parameters for operating the X-ray source. By way of example, the controller may be configured to determine a voltage supplied to the cathode, a current supplied to the cathode according to the switching action, and/or a duty cycle. Moreover, the controller may be configured to determine one or more periods of time in which the X-ray beam is switched on and/or off. Also, a frequency of such periods of time may be determined by the controller. Further, the controller may be configured to determine a control signal provided to the electron optics according to the determined switching action. Based on one or more of the parameters described above, the controller may predict the shape and the size of the focal spot.

The X-ray source according to the present disclosure may advantageously be used in any X-ray imaging application, in which the X-ray beam is modified during an imaging task and/or during image acquisition. Examples of such applications are dual energy X-ray and/or kV-peak switching applications, in which an energy and/or energy distribution of the X-ray beam is varied during the imaging task, e.g. based on changing a voltage and/or current supplied to the cathode. A further example is grid switching, in which the electron beam may be blanked out in certain periods of time during the imaging task such that the X-ray beam is switched off in said periods of time, e.g. for dose modulation purposes. Yet a further example is dynamic focal spot positioning, in which the position of the focal spot on the anode may be varied and/or changed during the imaging task. In any of the applications described above or any combination thereof, also spectral filtering may be applied, e.g. based on changing a filter in the X-ray beam, moving a filter into the X-ray beam and/or moving a filter out of the X-ray beam. Such filter may e.g. comprise a filter grating.

In at least some of the X-ray imaging applications described above, certain attempts have been made in the past to adjust the size and the shape of the focal spot by means of a feedback control configured to compensate for changes in size and shape of the focal spot induced by a certain switching action. However, such feedback control only allows to compensate a change induced by a certain switching action after the change already occurred and hence after the change already affected the focal spot and/or the X-ray beam. Apart from that, e.g. when large variations of the X-ray beam have to be performed in a short period of time and/or after long periods of time where the X-ray beam was switched off, such a feedback control my not be capable of compensating the change induced by the switching action fast enough.

In contrast thereto, the prediction of the size and shape of the focal spot according to the present invention allows for a predictive and/or proactive control of the focal spot and/or the X-ray beam. Accordingly, the controller may be configured to proactively determine a predictive control signal based on the predicted size and shape of the focal spot. Further, the controller may be configured to determine and/or proactively determine a level of correction for the electron beam, e.g. for compensating the change in size and shape of the focal spot induced by the switching action. This allows for a prospective correction of any change in the size and shape occurring due to a switching action. For this purpose, the controller may comprise a predictive module, a predictive sub-controller, a predictive section and/or a predictive unit configured to predict the size and shape of the focal spot and/or configured to determine the predictive control signal. The controller may also be configured to feed forward the predictive control signal to other components of the X-ray source, such as e.g. a feedback control and/or a feedback control loop. If in addition to the predictive control a feedback control is utilized in the X-ray source, e.g. for fine-tuning the shape and size of the focal spot, any potential error in the predicted shape and size and/or the corresponding predictive control signal can be quickly and effectively corrected for by the feedback control, since the predicted shape and size of the focal spot should be close to desired values, towards which the feedback control may regulate the focal spot. Accordingly, by means of the predictive control according to the invention, a faster and more efficient overall control and/or regulation of the shape and size of the focal spot can be provided.

According to an embodiment of the invention, the controller is configured to predict a change of the size and the shape of the focal spot induced by the switching action and/or expected after the switching action is performed. The change of the size and shape induced by the switching action may be predicted relative to a current shape and size of the focal spot before the switching action is performed, initiated, completed and/or terminated. Alternatively or additionally, the controller is configured to actuate the electron optics to compensate for a change of the size and the shape of the focal spot induced by the switching action. For instance, the controller may be configured to determine a predictive control signal based on the predicted change of the size and shape of the focal spot. The predictive control signal may be indicative of the predicted change in size and shape and/or indicative of the size and shape of the focal spot after the switching action. Alternatively or additionally, the predictive control signal may be indicative of a correction and/or an adjustment of the electron beam in order to compensate for the change of the size and shape of the focal spot induced by the switching action. This allows to correct any change of the size and shape of the focal spot before this change actually occurs. Generally, the controller may be configured to actuate the electron optics to compensate for the change before, during and/or after the switching action. Accordingly, the controller may be configured to actuate the electron optics to compensate for the change before, during and/or after actuating the emitter arrangement to perform the switching action. In other words, the controller may be configured to actuate the emitter arrangement to perform the switching action in response to actuating the electron optics to compensate for the predicted change in size and shape of the focal spot.

According to an embodiment of the invention, the controller is configured to predict the size and the shape of the focal spot based on predicting a width and a height of the focal spot. This allows to precisely, quickly and/or accurately predict the size and the shape of the focal spot.

According to an embodiment of the invention, the controller is configured to predict the size and the shape of the focal spot based on a model modelling a width and a height of the focal spot as a function of a current supplied to the cathode, a voltage supplied to the cathode, and a heat load of the anode. Accordingly, the controller may be configured to determine the voltage, the current and/or the heat load to determine the width and the height of the focal spot expected after the switching action. Therein, the model may be an empirical model, which may be determined e.g. based on calibration measurements and/or simulations. Predetermined values of the width and height of the focal spot for one or more sets of the current, the voltage and/or the heat load may e.g. be stored in a list and/or look-up table. The controller may be configured to determine the width and the height of the focal spot based on the list and/or look-up table. Also, the controller may be configured to interpolate and/or extrapolate the one or more sets stored in said list and/or look-up table.

According to an embodiment of the invention, the controller is configured to predict the size and the shape of the focal spot based on predicting a heat load of the anode. Generally, the heat load of the anode, which may be indicative of a temperature of at least a part of the anode, may affect the size and/or shape focal spot, e.g. due to thermal expansion. Accordingly, predicting the heat load of the anode after the switching action may allow to precisely predict the shape and the size of the focal spot. Therein, the heat load may be calculated by the controller, e.g. based on the current and/or the voltage supplied to the cathode during and/or after the switching action. Further, to calculate the heat load, a time period (or a length thereof) the X-ray beam is on and/or a time period (or a length thereof) the X-ray beam was off can be taken into account. For instance, the heat load of the anode may reach a steady state if the X-ray beam was on for a certain time period. In such steady state, the heat load of the anode could be derived from the current and/or the voltage supplied to the cathode alone. If the X-ray beam was on for a short period of time only, such that the temperature or heat load may not have reached steady state, the time period, in which the X-ray beam was on and/or a length thereof may also be taken into account for calculating the heat load of the anode.

According to an embodiment, the controller is configured to determine, based on a pre-determined cooling rate of the anode, a heat load of the anode expected after the switching action and/or after the switching action is performed. By way of example, the cooling rate and/or a cooling curve may be predetermined for the anode as a function of the voltage and/or the current supplied to the cathode, wherein optionally the time period the X-ray beam was on and/or off may be taken into account. The cooling rate and/or the cooling curve may be stored in a data storage of the X-ray source and the controller may retrieve and/or derive the size shape based on the predetermined cooling rate and/or cooling curve. Moreover, the controller may be configured to determine the heat load based on a past and/or preceding heat load of the anode before switching action. Also, a time period, in which the X-ray beam was switched off before the switching action may be taken into account by the controller to precisely predict the heat load after the switching action as well as the shape and size of the focal spot.

According to an embodiment of the invention, the emitter arrangement further comprises a grid interposed between the cathode and the anode, wherein the grid is configured to blank out the electron beam in an on-state of the grid and to transmit the electron beam through the grid in an off-state of the grid. The controller is configured to switch the grid between the on-state and the off-state by providing a grid switch signal to the grid. The grid switch signal may e.g. be a pulse-width modulated signal. By means of the grid, the X-ray beam may be switched on when the grid is in the off-state and the X-ray beam may be switched off, when the grid is in the on-state. Accordingly, by means of the grid and/or the grid switching signal, an intensity of the X-ray beam emitted by the X-ray source may be varied during an imaging task. Generally, the grid may be configured to build-up a repellant negative charge to prevent electrons emitted by the cathode to reach the anode. Alternatively, the grid may be configured to build-up a positive charge to withdraw and/or purge electrons emitted from the cathode, such that the electrons do not reach the anode.

According to an embodiment of the invention, the controller is configured to determine the switching action based on a pre-determined grid switch profile and/or based on analyzing a pre-determined grid switch profile, wherein the grid switch profile defines and/or is indicative of a modulation of an intensity of the X-ray beam based on a sequence of at least one off-state of the grid and at least one on-state of the grid. The grid switch profile may e.g. comprise entries with a current and/or a voltage supplied to the cathode during the off-states of the grid. The grid switch profile may also comprise entries specifying the sequence of on-states and off-states of the grid. The controller may be configured to determine, based on the grid switch profile, a voltage supplied to the cathode, a current supplied to the cathode and/or a duty cycle for one or more periods of time, in which the X-ray beam is on and/or the grid is in the off state. Also, the controller may be configured to determine, based on the grid switch profile, one or more periods of time, in which the X-ray beam is on and/or the grid is in the off state. Hence, the controller may derive one or more characteristics for one or more switching actions from the grid switch profile. The grid switch profile may be stored in a data storage of the X-ray source and/or the grid switch profile may be accessed by the controller to determine the one or more switching actions.

According to an embodiment of the invention, the X-ray source further comprises a focal spot sensor for acquiring an image of the focal spot based on detecting X-ray radiation emitted from the anode, the acquired image being indicative of the shape, the size and the position of the focal spot on the anode. Therein, the controller is further configured to analyze the image acquired with the focal spot sensor in order to determine and/or thereby determining a change of at least one of the size, the shape and the position of the focal spot. Further, the controller is configured to adjust, by actuating the electron optics, at least one of the size, the shape and the position of the focal spot if a change of at least one of the size, the shape and the position of the focal spot is determined after the switching action is performed. The focal spot sensor may be part of a feedback control of the X-ray source, wherein the feedback control may be configured to compensate any changes of the size, shape and/or position after the switching action is performed, e.g. by fine-tuning the electron optics. This may allow to regulate the size, shape and/or position of focal spot, thereby making the focal spot largely unaffected e.g. by temperature changes and/or a heat load of the anode. By predicting the shape and the size before the switching action is performed and by actuating the emitter arrangement accordingly, it may be ensured that the feedback control of the X-ray source does not have to compensate large variations of the size, shape and/or the position of the focal spot after the switching action is performed. Based on the feedback control only minor changes, e.g. due to thermal expansion, may be corrected for. This combination of predictive control and feedback control allows to control the size and the shape of the focal spot more precisely, more quickly, more efficiently and more reliably.

According to an embodiment of the invention, the controller is configured to analyze the image acquired by the focal spot sensor when and/or only when the grid is in the off-state and the electron beam impinges onto the anode. Alternatively or additionally, the controller is configured to discard the image acquired by the focal spot sensor when the grid is in the on-state and the electron beam is blanked out by the grid. This way, it can be ensured that the controller does not analyze dark images and/or images acquired by the focal spot sensor during time periods, in which the grid is in the on-state and blanks out the electron beam, but only analyzes images acquired by the focal spot sensor during time periods, in which the grid is in the off-state and the X-ray beam is on. Analyzing an image during the on-state of the grid, in which the X-ray beam is off, may be misinterpreted by the controller as loss of intensity, and the controller may try to compensate for this loss of intensity by actuating the electron optics. Accordingly, by only analyzing images of the focal spot sensor when the grid is in the off-state, erroneous actuation of the electron optics can be prevented.

According to an embodiment of the invention, the controller is configured to determine, based on the grid switch signal provided to the grid, if the image of the focal spot is acquired by the focal spot sensor during the off-state of the grid. Accordingly, the grid switch signal may trigger the controller to analyze the image acquired by the focal spot sensor. Using the grid switch signal as an indicator for the on-state and/or the off-state of the grid may allow to precisely and reliably differentiate between images of the focal spot sensor acquired during the on-state and the off-state of the grid.

According to a second aspect of the invention, an X-ray imaging apparatus is provided. The X-ray imaging apparatus comprises an X-ray source, as described above and in the following, and an X-ray detector for detecting X-ray radiation emitted by the X-ray source.

According to a third aspect of the invention, a method for operating an X-ray source is provided. The X-ray source may refer to the X-ray source as described above and in the following. Particularly, the X-ray source comprises an anode and an emitter arrangement having a cathode for emitting an electron beam and having an electron optics for focusing the electron beam at a focal spot on the anode. The X-ray source further comprises a controller. The method comprises the following steps:

- determining, with the controller, a switching action of the emitter arrangement, the switching action being associated with a change of at least one of a position of the focal spot on the anode, a size of the focal spot, and a shape of the focal spot;
- predicting, with the controller based on the determined switching action, the size and the shape of the focal spot expected after the switching action is performed; and
- actuating the emitter arrangement to perform the switching action.

Further, the method may, for example, comprise a step of actuating, with the controller, the electron optics, thereby compensating for a change of the size and the shape of the focal spot induced, e.g. expectedly induced, by the switching action. Therein, the switching action may be performed preferably after and/or during the actuation of the electron optics for compensating for the change in size and shape of the focal spot. However, the switching action may, alternatively or additionally, be performed before the actuation of the electron optics for compensating for the change in size and shape of the focal spot.

According to a fourth aspect of the invention, a computer program element is provided, which, when being executed by a controller of an X-ray source, is configured to cause the X-ray source to perform steps of the method, as described above and in the following. The computer program element may comprise software instructions. The computer program element may e.g. be stored in a data storage of the X-ray source, and the controller may be configured to access and execute the program element.

According to fifth aspect of the invention, a computer readable medium is provided, which has stored thereon the program element, as described above and in the following.

These and other aspects of the invention will be apparent from and elucidated with reference to the embodiments described hereinafter.

BRIEF DESCRIPTION OF THE DRAWINGS

The subject-matter of the invention will be explained in more detail in the following with reference to exemplary embodiments which are illustrated in the attached drawings, wherein.

In principle, identical or like parts are provided with identical or like reference symbols in the figs.

DETAILED DESCRIPTION OF EMBODIMENTS

Figure 1:
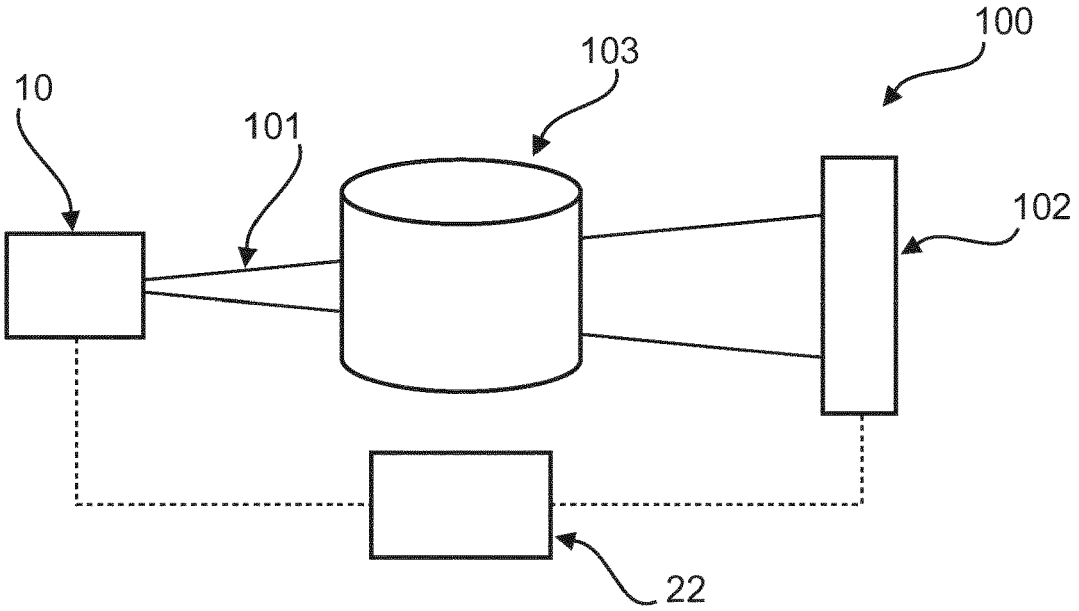
FIG. 1 shows schematically an X-ray imaging apparatus according to an exemplary embodiment of the invention.

FIG. 1 shows schematically an X-ray imaging apparatus 100 according to an embodiment of the invention. The X-ray imaging apparatus may refer to any type of imaging system, such a digital X-ray imaging system, a dual or multi energy X-ray imaging system, Computed Tomography (CT), spectral CT, interventional X-R (IXR), digital-X-R (DXR), a C-arm system, and/or multimodality systems like PET/CT.

The X-ray imaging apparatus 100 comprises an X-ray source 10 for generating and/or emitting an X-ray beam 101 towards an object 103 to be examined and an X-ray detector 102 for detecting at least a part of the X-ray beam 101 that has passed through the object 103. The X-ray source 10 can refer to any X-ray source, such as e.g. an X-ray tube, a stereo X-ray tube or any other type. The X-ray source 10 will be described in more detail in subsequent figs.

Likewise, the X-ray detector 102 can refer to any suitable X-ray detector 102. Particularly, the X-ray detector 102 can comprise a scintillator for converting X-ray photons into visible light. Further, the X-ray detector 102 can comprise one or more detecting elements for detecting light emitted from scintillator. Further, 102 can comprise a direct conversion detector for converting X-ray photons into electrical charges, and can comprise detecting elements for charge integration or single photon counting.

Further, the X-ray imaging apparatus 100 comprises a controller 22 operationally coupled to the X-ray detector 102 and the X-ray source 10. However, the controller 22 may be part of the X-ray source 10, as described with reference to subsequent figs., and/or part of the X-ray detector 102. Also, the controller 22 may refer to a controller arrangement 22 having one or more sub-controllers, modules and/or units.

Figure 2:
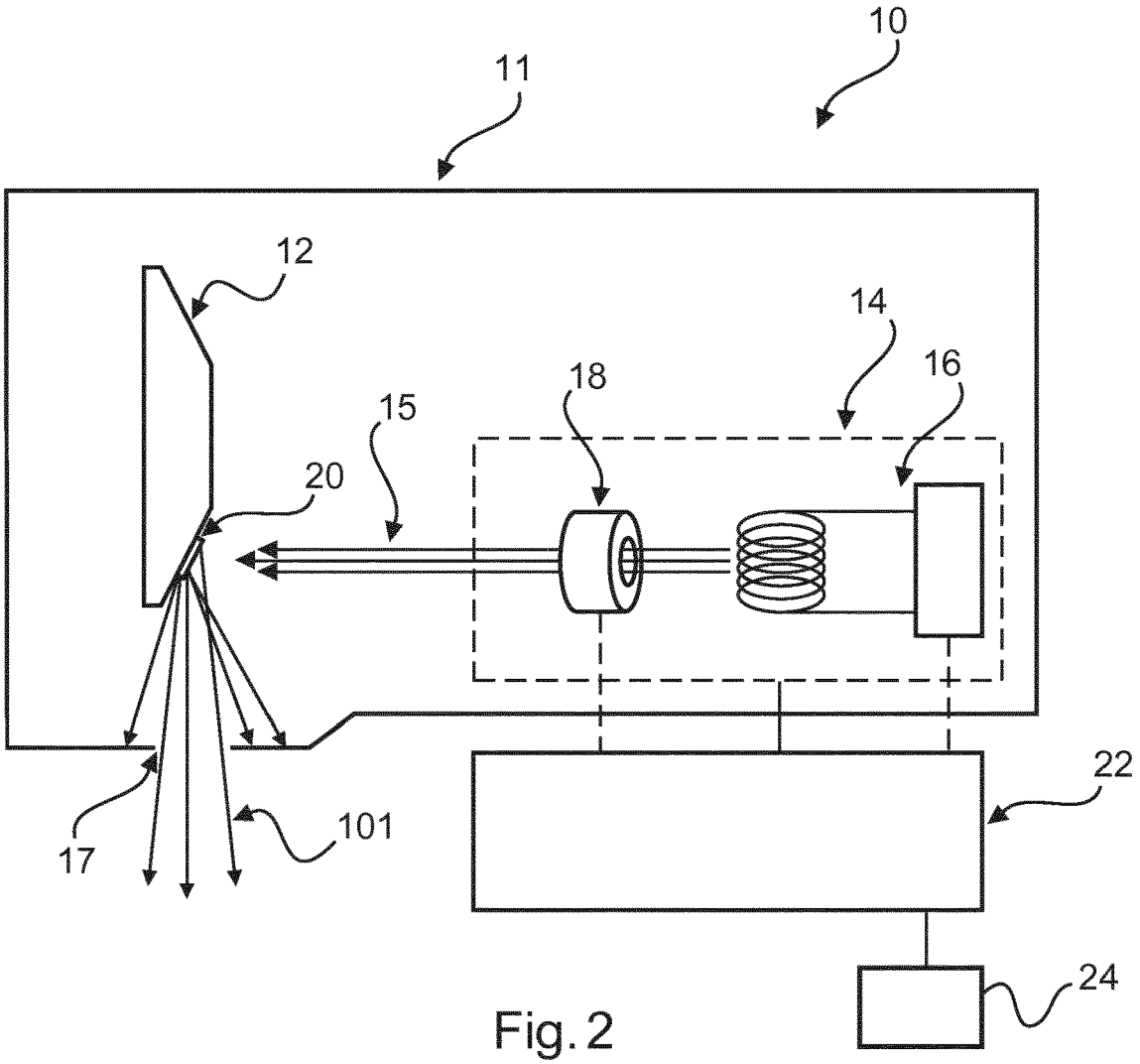
FIG. 2 shows schematically an X-ray source according to an exemplary embodiment of the invention.

FIG. 2 shows schematically an X-ray source 10 according to an exemplary embodiment of the invention.

The X-ray source 10 comprises a housing 11 and an anode 12 arranged in the housing 11. The anode 12 may be any type of anode. For instance, the anode 12 may be a rotatable and/or movable anode 12.

The X-ray source 10 further comprises an emitter arrangement 14 with a cathode 16 for emitting an electron beam 15 towards the anode 12. The emitter arrangement 14 further comprises an electron optics 18 for focusing the electron beam 15 on the anode 12 and/or on an outer surface thereof. The electron optics 18 may be configured to generate an electric field and/or a magnetic field to deflect the electron beam 15 and to focus the electron beam 15 on the anode 12.

The electron beam 15 is focused at a focal spot 20 on the anode 12. Therein, the focal spot 20 may refer to an area and/or region of the anode 12, in which the electron beam 15 impinges onto the anode 12. When impinging onto the anode 12, the electron beam 15 generates X-ray radiation and/or X-ray photons emitted from the anode 12 and/or from the focal spot 20. At least a part of the emitted X-ray photons can pass through an X-ray window 17 of the X-ray source 10 to form the X-ray beam 101.

The X-ray source 10 further comprises a controller 22 operatively coupled to the emitter arrangement 14, the electron optics 18 and/or the cathode 16.

The X-ray source 10 shown in FIG. 2 may advantageously be utilized in imaging applications, in which a characteristic of the X-ray beam 101 and/or the X-ray beam 101 may be adjusted and/or modified during an imaging task and/or during acquisition of an X-ray image. Particularly, the X-ray source 10 depicted in FIG. 1 may be configured for kV-peak or kVp switching, where an energy and/or energy distribution of the X-ray beam 101 is modified and/or varied during the imaging task, as e.g. used for dual energy X-ray imaging. In kV-peak switching applications, an electrical power supplied to the cathode 16 may be switched in a corresponding switching action between at least two power levels. For instance, a voltage supplied to the cathode 16 may be changed from e.g. 80 kV to 140 kV during a single imaging task and/or during a switching action. Alternatively or additionally a current supplied to the cathode 16 may be changed during a switching action. Therein, the actual switching action usually takes place in a rather short time scale, e.g. in the range of microseconds to milliseconds.

However, any change of the voltage and/or current supplied to the cathode 16 may affect at least one of a shape, a size and a position of the focal spot 20 on the anode 12. This in turn may affect the X-ray beam 101 and/or a characteristic of the X-ray beam 101, e.g. due to a changing heat load and/or temperature of the anode 12 and/or due to different properties of the electrons of the electron beam 15 impinging onto the anode 12 at different energies. To ensure a high image quality of an X-ray image, it may be favorable to precisely control the shape and the size of the focal spot 20. This can be accomplished by the X-ray source 10 according to the present invention, as described in the following.

The controller 22 is configured to determine the switching action of the emitter arrangement 14. Determining the switching action may comprise determining one or more values of parameters for operating the X-ray source 12, such as e.g. the voltage and/or the current supplied to cathode 16. The controller 22 may also determine other parameters of the switching action, such as e.g. a control signal provided to the electron optics 18, a time period, in which the switching action is performed, and/or a time instant, at which the switching action is performed. Such parameters of the switching action may be input to the X-ray source 10 by a user and/or may be retrieved by the controller from a data storage 24 and/or data stored therein. Further, the controller 22 is configured to actuate the emitter arrangement 14 to perform the switching action.

Before actuating the emitter arrangement 14 to perform the switching action, the controller 22 determines, calculates and/or predicts the shape and the size of the focal spot 20 expected after the switching action. Based on the determined switching action, the controller 22 can predict and/or estimate the shape and size of the focal spot 20 that will expectedly be present after the switching action is performed. Alternatively or additionally, the controller 22 is configured to determine a change of the size and the shape of the focal spot 20 induced by the switching action. Accordingly, the controller 22 may be configured to determine a relative change of the size and shape of the focal spot, e.g. relative to a size and shape of the focal spot 20 before and/or prior to the switching action and/or during a current operation of the X-ray source 12.

Further, the controller 22 is configured to determine, based on the predicted size and shape of the focal spot 20 and/or based on the predicted change in the size and shape of the focal spot 20, a predictive control signal. The controller 22 may then provide the predictive control signal to the electron optics 18 directly before, during, at termination and/or when the switching action is completed in order to adjust the electron beam 15, thereby taking into account the switching action and the changes in size and shape of the focal spot induced therewith. This allows to proactively control the shape and the size of the focal spot 20 before any change in the focal spot 20 due to the performed switching action occurs or is noticeable. Accordingly, the change in size and shape of the focal spot 20 induced by the switching action can be compensated for, before this change actually occurs. Hence, a more precisely controlled X-ray beam 101 and/or a better image quality can be provided.

Generally, the controller 22 can be configured to determine the switching action and to predict the size and shape of the focal in response to determining the switching action. Further, the controller 22 can be configured to determine the predictive control signal in response to predicting the size and shape of the focal spot 20. Moreover, the controller 22 can be configured to actuate, based on the predictive control signal, the electron optics 18 in accordance with the predicted size and shape of the focal spot 20. In response thereto, the controller 22 can then initiate the switching action and/or actuate the emitter arrangement 14 to perform the switching action.

To determine the shape and the size of the focal spot 20 expected after the switching action, the controller 22 can determine a width and a height of the focal spot 20 expected after the switching action. For instance, the controller 22 can determine, based on the determined switching action, the voltage and/or the current supplied to the cathode 16 after the switching action, and the controller can estimate and/or calculate the width and the height of the focal spot 20. Also, a time period (or a length thereof) that the X-ray beam was on and/or off, which may e.g. be determined based on a switching profile describing one or more switching actions performed during image acquisition, can be taken into account to calculate the width and the height of the focal spot 20. Accordingly, the width and the height of the focal spot 20 may be a function of the voltage and/or current supplied to the cathode 16. Such functional relationship may be pre-determined, e.g. based on measurements, and the functional relationship may be stored in the data storage 24. Also, the width and the height of the focal spot 20 may be determined by the controller 22 based on a model modelling the height and the width of the focal spot 20 as a function of voltage and/or current supplied to the cathode. Alternatively or additionally a look-up table may be stored in the data storage 24 and the controller may determine the width and the height of the focal spot 20 based on the look-up table.

Alternatively or additionally, the controller 22 can be configured to determine a heat load and/or a temperature of at least a part of the anode 12 expected after the switching action. Based on the determined heat load and/or the temperature, the controller 22 may then predict the shape and the size of the focal spot 20 after the switching action.

The controller 22 may determine the heat load and/or the temperature e.g. based on a pre-determined cooling rate and/or a cooling curve of the anode, based on which a temperature of the anode may be calculated as a function of current and/or voltage supplied to the cathode 16. Therein, also a previous operation of the X-ray source, such as e.g. a time period preceding switching action, in which time period the X-ray beam was switched off, may be taken into account. The cooling rate and/or the cooling curve may be stored in the data storage 24. Accordingly, the controller 22 may be configured to predict the size and the shape of the focal spot 20 based on the voltage supplied to the cathode 16 after the switching action, based on the current supplied to the cathode 16 after the switching action and/or based on the heat load expected after the switching action. For this purpose, the controller 22 may be configured to predict the shape and the size of the focal spot 20 based on a model modelling the width and the height of the focal spot 20 as a function of the voltage supplied, the current and/or the heat load of the anode. Alternatively or additionally, a look-up table may be stored in the data storage 24, and the controller 22 may determine the width and the height of the focal spot 20 expected after the switching action based on the look-up table. It is to be noted that in addition to changing the voltage and/or current supplied to the cathode 16 in the frame of the switching action, also a filter and/or filter grating may be moved into the X-ray beam 101 and/or out of the X-ray beam 101 in the course of the switching action.

Further, alternatively or additionally to the kV-peak switching described above, also dynamic focal spot positioning may be applied, wherein a position of the focal spot 20 on the anode may be changed, by deflecting the electron beam 15 with the electron optics 18, in a separate switching action or simultaneously with changing the voltage and/or current supplied to the cathode 16. Analogue to the description above, the controller 22 is configured to predict the size and shape of the focal spot 20 inferred by changing a position of the focal spot 20 on the anode 12 and to actuate the electron optics 18 to compensate for such a change in position.

Figure 3:
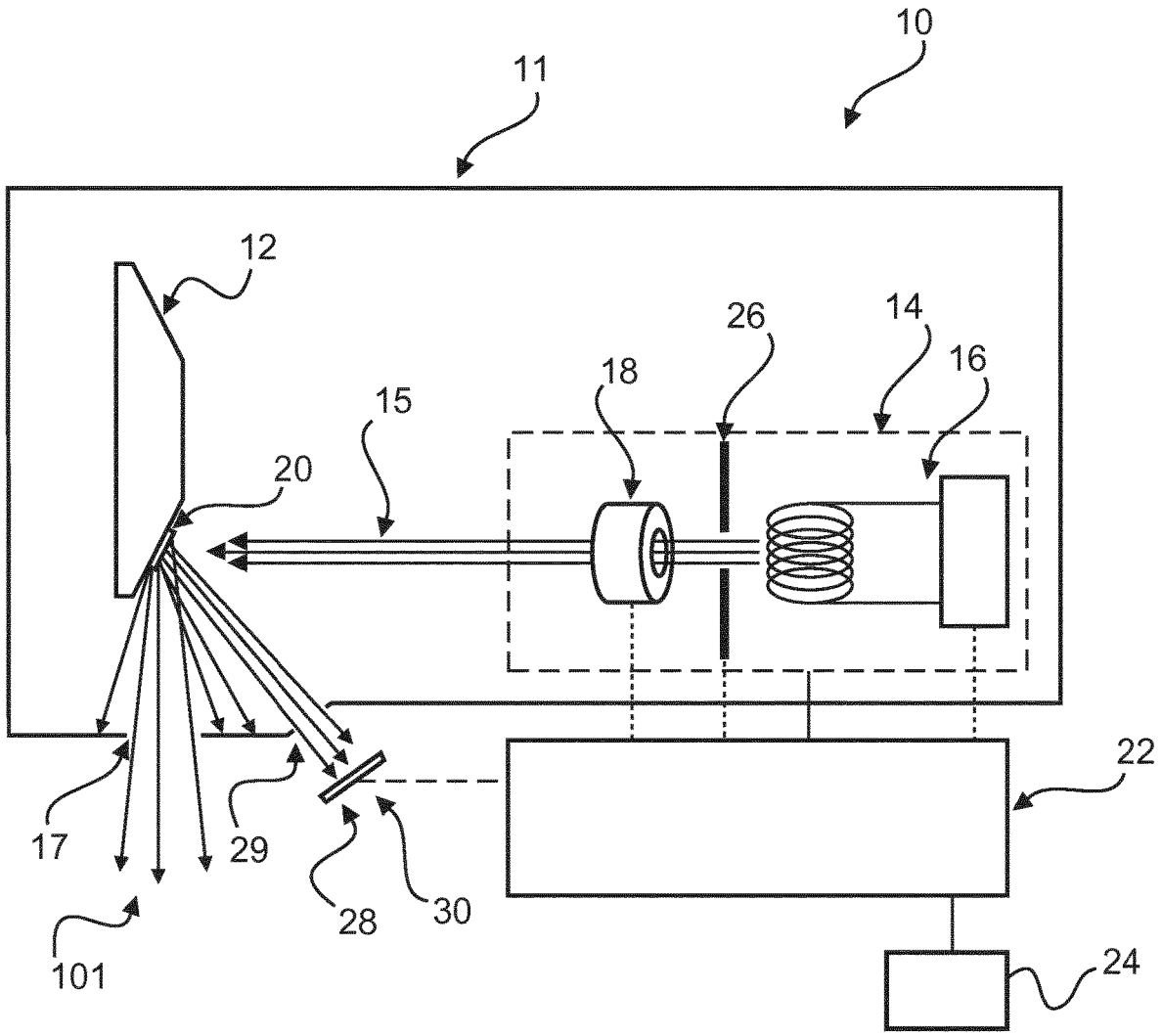
FIG. 3 shows schematically an X-ray source according to an exemplary embodiment of the invention.

Alternatively or additionally, grid switching may be applied, wherein the X-ray beam 101 is switched on and/or off during an imaging task, as described in more detail in FIG. 3.

It is to be noted that the exemplary embodiment of the X-ray source 10 illustrated FIG. 2 can also comprise further components, e.g. as described with reference to FIG. 3. Particularly, also the X-ray source 10 of FIG. 2 can comprise a focal spot sensor 28 and/or a feedback control 30, as described with reference to FIG. 3 in the following.

FIG. 3 shows schematically an X-ray source 10 according to an exemplary embodiment of the invention. If not stated otherwise, the X-ray source 10 of FIG. 3 comprises the same features, functions and/or elements as the X-ray source 10 described with reference to FIGS. 1 and 2.

In the embodiment depicted in FIG. 3, the emitter arrangement 14 comprises a grid 26 interposed between the cathode 16 and the anode 12. In an on-state of the grid 26, the grid 26 blanks out the electron beam 15, and hence switches the X-ray beam 101 off. In an off-state of the grid 26, the electron beam 15 can pass through the grid 26 and impinge onto the anode 12, such that the X-ray beam 101 is on. The controller 22 is operatively coupled to the grid 26 and is configured to switch the grid 26 between the on state and the off-state based on providing a grid switch signal to the grid 26. The grid switch signal may refer to a pulse width modulation signal for actuating the grid 26. Such grid switching may particularly be advantageous for generating pulsed X-ray beams and/or for dose modulation techniques, in which an intensity of the X-ray beam 101 is varied based on switching the grid 26 between the on-state and the off-state. A sequence of on-states and off-states of the grid 26 may e.g. be defined in a grid switch profile that may be stored in the data storage 24 and/or provided to the controller 22. The controller 22 may then determine the grid switch signal based on the grid switch profile and actuate the grid 16 accordingly.

The X-ray source 10 depicted in FIG. 3 further comprises a focal spot sensor 28 for acquiring an image of the focal spot 20 based on detecting X-ray radiation emitted from the focal spot 20 and e.g. transmitted through a window 29 in the housing 11. During operation of the X-ray source 10, the controller 22 analyzes the images acquired with the focal spot sensor 28 to monitor the shape, the size and the position of the focal spot 20. Further, the controller 22 determines a change in size, shape and/or position of the focal spot 20 based on analyzing images acquired with the focal spot sensor 28. Moreover, the controller 22 actuates the electron optics 18 to compensate for a change in size, shape and/or position of the focal spot 20. Accordingly, the focal spot sensor 28 and the controller 22 or a dedicated module, part, section, sub-controller or unit of the controller 22 form a feedback control 30 of the X-ray source 10 for stabilizing the focal spot 20 in terms of its shape and size based on actuating the electron optics 18. The feedback control 30 may be particularly advantageous for compensating thermal expansion of the anode 12 during operation However, the actuation of the electron optics 18 based on images of the focal spot sensor 28 is not to be confused with the prediction of the shape and size of the focal spot before the switching action is performed and the corresponding actuation of the electron optics 18 based on the predicted shape and size. For the predictive control, the controller 22 may determine the switching action based on the grid switch signal and/or based on the grid switch profile and predict the shape and the size of the focal spot 20 for the determined switching action. Determining the switching action may comprise determining a time period of an on-state and/or an off-state of the grid 26, to a voltage supplied to the cathode, to a current supplied to the cathode, and/or to a control signal supplied to the electron optics 18. Based on the predicted shape and size of the focal spot 20, the controller 22 may actuate the electron optics 18 to compensate for the switching action, as described with reference to FIG. 2.

Before switching the X-ray beam 101 on and/or off by means of the grid 26, i.e. during a grid-switch operation of the X-ray source 10, the controller 22 can determine based on the switching signal and/or based on the grid switch profile a duty-cycle, the on-states and/or the off-states of the grid 26 in advance. This information can then be used to predict the shape and size of the focal spot 20, to proactively determine the predictive control signal and/or a correction for the changes in size and shape of the focal spot 20, as described in detail with reference to FIG. 2. In contrast to this proactive and/or predictive control, the adjustment of the electron beam 15 by means of the feedback control 30 and/or the focal spot sensor 28 may serve to fine-tune the electron beam 15 and/or the electron optics 18, e.g. to compensate for thermal expansion during off-states of the grid 26, as will be described in more detail in the following.

The feedback control 30 depicted in FIG. 3 may be considered as being based on the following insights and findings. When using a grid 26, e.g. in a grid switch X-ray source 10 or grid switch tube, in combination with focal spot sensing by means of the focal spot sensor 28 and the corresponding feedback control 30, it may be desirable to take certain precautions in order to ensure that periods of time, in which the electron beam 15 is blanked-out, are not interpreted as a loss of intensity by the controller 22 when analyzing an image of the focal spot sensor 28. Accordingly, a sampling rate of the feedback control 30 may be irregular when using a grid 26 for grid switching. Apart from that, a period of time between consecutive X-ray images may vary, and hence, also a temperature of the anode 12 may vary between acquisitions of two consecutive X-ray images. Such temperature differences may in turn affect the size and the shape of the focal spot 20, which would cause the feedback control 30 to work on correcting large deviations or changes, e.g. when compared to an X-ray source 10 operating continuously. This might be particularly the case if the grid 26 is used for dose modulation, in which for example a certain gantry rotation angle may cause a significantly larger heat load on the anode 12 than in other rotation angles. Furthermore, when using dynamic focal spot positioning, e.g. for filter modulation to tune the spectral filtration via a filter, may also switch between two positions of the focal spot 20 with two different intensities. Moreover, e.g. in C-arc systems a dose control may be directly influenced by the measured beam intensity. E.g. in case of a frame to frame modulation the feedback control 30 would normally regulate the voltage and/or current according to given dose changes and time constants. All these aspects should preferably be taken into account in the feedback control 30 to control the shape and size of the focal spot 20 in order to ensure a high image quality.

As described above, the focal spot sensor 28 is configured to dynamically monitor the shape and size of the focal spot 20. To avoid any correction of the shape and size of the focal spot 20 based on an image of the focal spot sensor acquired when the X-ray beam is off and/or when the grid is in the on-state, the controller 22 is configured to analyze the image of the focal spot sensor 28 only when the grid is in the off-state and to disregard an image of the focal spot sensor 28 acquired when the grid is in the on-state. The controller 22 may determine whether a given image of the focal spot sensor 28 is acquired during the off-state of the grid 26 based on the grid switch signal and/or based on the grid switch profile. For instance, the grid switch signal may be used to trigger analyzing the image acquired by the focal spot sensor 28, such that the controller 22 only analyzes images of the focal spot sensor acquired when the grid 26 is in the off-state. By way of example, the grid switch signal may be used by the controller 26 to sample-and-hold the image of the focal spot sensor 28 thereby preventing misguiding the feedback control 30 by analyzing dark images when the X-ray beam 101 is off.

Accordingly, by taking only images of the focal spot sensor 28 that are acquired during the off-state of the grid 26 and/or when the X-ray beam 101 is on, the control and/or regulation of the shape and size of the focal spot 20 by means of the feedback control 30 can be significantly improved.

In addition to this feedback control 30, in the frame of the predictive control, the controller 22 can determine and or predict an expected heat load of the anode 12, as described with reference to FIG. 2. The heat load of the anode 12 may be determined e.g. based on the grid-switch profile for at least a subset of switching actions defined therein. Accordingly, the controller 22 may have access to prior knowledge on the immediate requirements in terms of X-ray on periods and can therefore predict, e.g. based on a model modelling the heat load of the anode 12 as a function of current and/or voltage supplied to the cathode, the predictive control signal to compensate for any changes in size and shape of the focal spot, particularly before any variation of the focal spot is noticeable. This may also be advantageous for reducing control transients which might occur after relatively prolonged X-ray off periods, where the feedback control 30 might otherwise still apply corrections which were adequate at a higher anode temperature. Prior knowledge allows the controller 22 to predict the anode temperature at the time that X-ray beam 101 is switched on again, thereby reducing the reaction time of the feedback control 30.

It is emphasized that any features functions and/or functionalities as described with reference to any of FIGS. 1 to 3 can be combined.

Figure 4:
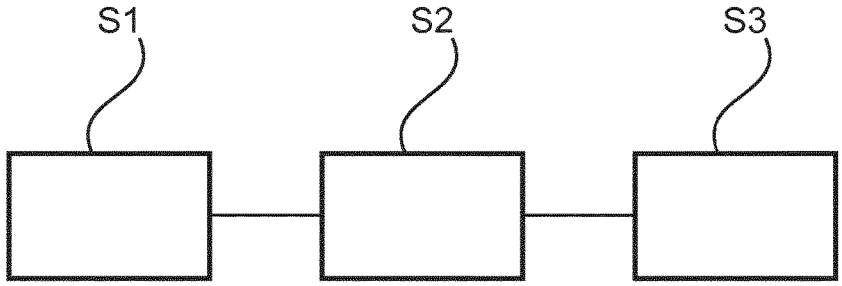
FIG. 4 shows a flow chart illustrating steps of a method for operating an X-ray source according to an exemplary embodiment of the invention.

FIG. 4 shows a flow chart illustrating steps of a method for operating an X-ray source 10 according to an exemplary embodiment of the invention. If not stated otherwise, the X-ray source 10 comprises the same features, functions and/or elements as the X-ray source 10 described with reference to any of the preceding FIGS. 1 to 3. Particularly, the X-ray source 10 comprises an anode 12 and an emitter arrangement 14 having a cathode 16 for emitting an electron beam 15 and having an electron optics 18 for focusing the electron beam 15 at a focal spot 20 on the anode 12. The X-ray source 10 further comprises a controller 22.

In a step S1 of the method, a switching action of the emitter arrangement 14 is determined by the controller 22, wherein the switching action is associated with a change of at least one of a position of the focal spot 20 on the anode 12, a size of the focal spot 20, and a shape of the focal spot 20.

In a further step S2, based on the determined switching action, the size and the shape of the focal spot 20 expected after performing the switching action is predicted with the controller 22 based on the determined switching action. Optionally, in step S2 the controller 22 may predict a change of the size and shape of the focal spot 20 induced by the switching action.

In a further step S3, the emitter arrangement 14 is actuated by the controller 22 to perform the switching action. Before, during or after performing the switching action, the controller 22 may further actuate the electron optics 18 based on the predicted size and shape of the focal spot 20, such that any change and/or variation in size and shape of the focal spot 20 induced by the switching action is compensated.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An X-ray source for emitting an X-ray beam, the X-ray source comprising:

an anode;

an emitter arrangement comprising a cathode for emitting an electron beam towards the anode and an electron optics for focusing the electron beam at a focal spot on the anode; and a controller configured to determine a switching action of the emitter arrangement and to actuate the emitter arrangement to perform the switching action, the switching action being associated with a change of at least one of a position of the focal spot on the anode, a size of the focal spot on the anode, and a shape of the focal spot on the anode;

wherein the controller is configured to predict before the switching action is performed, based on the determined switching action, the size and the shape of the focal spot expected after the switching action; and wherein the controller is configured to actuate the electron optics to compensate for a change of the size and the shape of the focal spot induced by the switching action.

2. The X-ray source according to claim 1, wherein the controller is configured to predict a change of the size and the shape of the focal spot induced by the switching action.

3. The X-ray source according to claim 1, wherein the switching action comprises at least one of changing a voltage supplied to the cathode, changing a current supplied to the cathode, changing a position of the focal spot on the anode by deflecting the electron beam with the electron optics, and switching the X-ray beam on.

4. The X-ray source according to claim 1, wherein the controller is configured to predict the size and the shape of the focal spot based on predicting a width and a height of the focal spot.

5. The X-ray source according to claim 1, wherein the controller is configured to predict the size and the shape of the focal spot based on a model modelling a width and a height of the focal spot as a function of a current supplied to the cathode, a voltage supplied to the cathode, and a heat load of the anode.

6. The X-ray source according to claim 1, wherein the controller is configured to predict the size and the shape of the focal spot based on predicting a heat load of the anode; and/or wherein the controller is configured to determine, based on a pre-determined cooling rate of the anode, a heat load of the anode expected after the switching action.

7. The X-ray source according to claim 1, wherein the emitter arrangement further comprises a grid interposed between the cathode and the anode, wherein the grid is configured to blank out the electron beam in an on-state of the grid and to transmit the electron beam in an off-state of the grid; and wherein the controller is configured to switch the grid between the on-state and the off-state by providing a grid switch signal to the grid.

8. The X-ray source according to claim 7, wherein the controller is configured to determine the switching action based on a pre-determined grid switch profile, the grid switch profile defining a modulation of an intensity of the X-ray beam based on a sequence of at least one off-state of the grid and at least one on-state of the grid.

9. The X-ray source according to claim 7, further comprising:

a feedback control with a focal spot sensor for acquiring an image of the focal spot based on detecting X-ray radiation emitted from the anode, the acquired image being indicative of the shape, the size and the position of the focal spot on the anode; and wherein the controller is further configured to analyze the image acquired with the focal spot sensor to determine a change of at least one of the size, the shape and the position of the focal spot; and wherein the controller is configured to adjust, by actuating the electron optics, at least one of the size, the shape and the position of the focal spot if a change of at least one of the size, the shape and the position of the focal spot is determined after the switching action is performed.

10. The X-ray source according to claim 9, wherein the controller is configured to analyze the image acquired by the focal spot sensor when the grid is in the off-state and the electron beam impinges onto the anode; and/or wherein the controller is configured to discard the image acquired by the focal spot sensor when the grid is in the on-state and the electron beam is blanked out by the grid.

11. The X-ray source according to claim 9, wherein the controller is configured to determine, based on the grid switch signal, if the image of the focal spot is acquired by the focal spot sensor during the off-state of the grid.

12. A method for operating an X-ray source comprising an anode, an emitter arrangement having a cathode for emitting an electron beam and having an electron optics for focusing the electron beam at a focal spot on the anode, and a controller, the method comprising:

determining, with the controller, a switching action of the emitter arrangement, the switching action being associated with a change of at least one of a position of the focal spot on the anode, a size of the focal spot, and a shape of the focal spot;

predicting, with the controller based on the determined switching action, the size and the shape of the focal spot expected after the switching action is performed;

actuating, with the controller, the electron optics in order to compensate for a change of the size and the shape of the focal spot induced by the switching action; and actuating the emitter arrangement to perform the switching action.

13. A non-transitory computer-readable medium having executable instructions stored thereon which, when executed by at least one processor, cause the at least one processor to perform the method according to claim 12.

* * * * *